US008596448B2

(12) United States Patent
Sempe

(10) Patent No.: US 8,596,448 B2
(45) Date of Patent: Dec. 3, 2013

(54) FOLDABLE GLASSES CASE

(75) Inventor: Inga Sempe, Paris (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 244 days.

(21) Appl. No.: 13/021,038

(22) Filed: Feb. 4, 2011

(65) Prior Publication Data

US 2011/0210019 A1 Sep. 1, 2011

(30) Foreign Application Priority Data

Feb. 5, 2010 (EP) ..... 10305125

(51) Int. Cl.
*B65D 6/18* (2006.01)
*A45C 11/04* (2006.01)

(52) U.S. Cl.
USPC ..... 206/6; 220/666; 220/6; 220/4.28

(58) Field of Classification Search
USPC ..... 206/6, 546, 577; 220/620, 4.28, 666, 220/660, 667, 600, 6; 229/117.05, 117.07, 229/117.08
See application file for complete search history.

(56) References Cited

U.S. PATENT DOCUMENTS 3,197,062 A * 7/1965 Day et al. ..... 221/48
4,678,095 A * 7/1987 Barnett et al. ..... 220/4.21
3,276,572 A 10/1996 Everburg
5,996,882 A * 12/1999 Randall ..... 229/117.05
6,315,151 B1 * 11/2001 Hupp et al. ..... 220/666
2010/0051616 A1 * 3/2010 Shea et al. ..... 220/4.28

FOREIGN PATENT DOCUMENTS

DE 8701346 U1 3/1987
DE 9310493 U1 10/1993
EP 0613827 A1 9/1994

OTHER PUBLICATIONS

European Search Report, dated Jun. 30, 2010, from corresponding European application.

* cited by examiner

*Primary Examiner* — Mickey Yu
*Assistant Examiner* — Chun Cheung
(74) *Attorney, Agent, or Firm* — Young & Thompson

(57) ABSTRACT

The invention concerns a glasses case including a bottom panel, a frame and four side walls, which case has a folded configuration in which a first panel and a second panel of each wall of a first pair of side walls are inclined towards each other pointing outwardly whereas a first panel and a second panel of each wall of a second pair of side walls are inclined towards each other pointing inwardly, and a deployed configuration in which a first panel and a second panel of each side wall are inclined towards each other pointing inwardly, and a first panel and a second panel of each wall of the first pair of side walls bear on the remaining sides of the panels of the second pair of side walls.

15 Claims, 4 Drawing Sheets

FOLDABLE GLASSES CASE

BACKGROUND OF THE INVENTION

The invention concerns a glasses case capable of adopting a deployed configuration and a folded configuration.

Such a glasses case is already known from the European patent application 0 613 827, which comprises a strip comprising a first wall, a second wall, a third wall and a fourth wall, the first wall being hinged by a first side to the second wall and hinged by a second side, that is an opposite side to its first side, to a first side of the third wall, and the third wall being hinged by a second side, that is an opposite side to its first side, to the fourth wall.

The case also comprises two folding gusset-forming side walls between the first wall and the second wall.

In its deployed and closed configuration, the case takes the shape of a prism with three main faces one of which is formed by the second wall and by the fourth wall which covers the second wall while the other two are respectively formed by the first wall and by the third wall, the side walls being raised.

In its deployed and open configuration, the case is in a similar state to its deployed and closed configuration but with the third wall and fourth wall flattened in line with the first wall to free an opening for putting in place or removing a pair of glasses.

In the folded configuration of the case, the first wall and the second wall are flat in line with each other, the third wall and the fourth wall are flat in line with each other above the first and second walls, and the two side walls are folded back and interposed between the first wall and the third wall.

BRIEF SUMMARY OF THE INVENTION

The invention aims to provide a foldable glasses case that is simple and convenient and having in particular reduced voluminosity in its folded configuration.

The invention thus relates to a glasses case having a deployed configuration and a folded configuration, comprising:

a bottom panel having a perimeter formed by four sides, respectively a first side and a second side which are opposite sides as well as a third side and a fourth side which are opposite sides;

a frame surrounding an entry opening, which frame faces the bottom panel and has an outer perimeter formed by four sides, respectively a first side and a second side which are opposite sides as well as a third side and a fourth side which are opposite sides; and four side walls, respectively a first side wall extending between the first side of the bottom panel and the first side of the frame, a second side wall extending between the second side of the bottom panel and the second side of the frame, a third side wall extending between the third side of the bottom panel and the third side of the frame, a fourth side wall extending between the fourth side of the bottom panel and the fourth side of the frame; each side wall comprising a first panel and a second panel that are hinged to each other by a first side, the first panel having a second side, that is an opposite side to the first side, by which it is hinged to the bottom panel, the second panel having a second side, that is an opposite side to the first side, by which it is hinged to the frame; the first and second side walls forming a first pair of opposite side walls, the third and fourth side walls forming a second pair of opposite side walls, the panels of the second pair of side walls having a trapezoidal perimeter with their first side shorter than their second side and their two remaining sides slanted;

the first panel and the second panel of each wall of the first pair of side walls being inclined towards each other pointing outwardly while the first panel and the second panel of each wall of the second pair of side walls being inclined towards each other pointing inwardly, in the folded configuration of the case; and the first panel and the second panel of each side wall being inclined towards each other pointing inwardly, and the first panel and the second panel of each wall of the first pair of side walls bearing on the remaining sides of the panels of the second pair of side walls, in the deployed configuration of the case.

The glasses case according to the invention, in its deployed configuration, has a rectangular cross-section.

It its folded configuration, the case is flat, and of vary small thickness.

The case furthermore has an outline of width equal to the width of the bottom panel, and an outline of length longer by two side wall panels (one on each side) than the length of the bottom panel.

In its folded configuration, the case thus has a narrow character that is particularly convenient to slide it into a pocket, for example a jacket or shirt pocket.

According to preferred simple, convenient and economic features of the glasses case according to the invention:

the panels of the first pair of side walls have a rectangular perimeter with their two remaining sides straight;

the case comprises a cover adapted to come to bear against the frame, which cover has a perimeter formed by four sides, respectively a first side and a second side which are opposite sides as well as a third side and a fourth side which are opposite sides, with one of the four sides of said cover being hinged to the second side of a second panel of one of said side walls or to a side of said frame;

each side wall is formed as a single piece, and the first and second panels of each side wall are hinged by a fold formed at the first side of said first and second panels of each side wall;

the first and second panels of each side wall are hinged by a first linking device formed from a flexible material;

each first panel of each side wall is hinged to the bottom panel by a second linking device, and each second panel of each side wall is hinged to the frame by a third linking device, the second and third linking devices being formed from a flexible material.

the case comprises a cover adapted to come to bear against the frame, which cover has a perimeter formed by four sides, respectively a first side and a second side which are opposite sides as well as a third side and a fourth side which are opposite sides, with one of the four sides of the cover being hinged to the second side of a second panel of one of the side walls or to a side of the frame by a fourth linking device formed from a flexible material;

the case comprises a first retaining system comprising at least a first member disposed on a panel of a wall of the first pair of side walls, and at least a second member disposed on a panel of a wall of the second pair of side walls, in the vicinity of a remaining side of the panel on which bears the panel of the wall of the first pair of side walls comprising the first member, which first member and second member, when they are at a predetermined distance from each other, are subject to a force which holds them at said predetermined distance or at a shorter distance;

the case comprises at least a second retaining system comprising at least a first member disposed on the bottom panel and at least a second member disposed on the frame, facing the first member;

the first member is formed by the panel on which it is disposed, formed from metal material, and the second member is formed by a magnetic metal plate; and the first and second members are formed by self-fastening retaining tabs.

BRIEF DESCRIPTION OF THE SEVERAL VIEWS OF THE DRAWINGS

The disclosure of the invention will now be continued with the description of embodiments, given below by way of illustrative and non-limiting example, with reference to the accompanying drawings, in which.

DETAILED DESCRIPTION OF THE INVENTION

Figure 1:
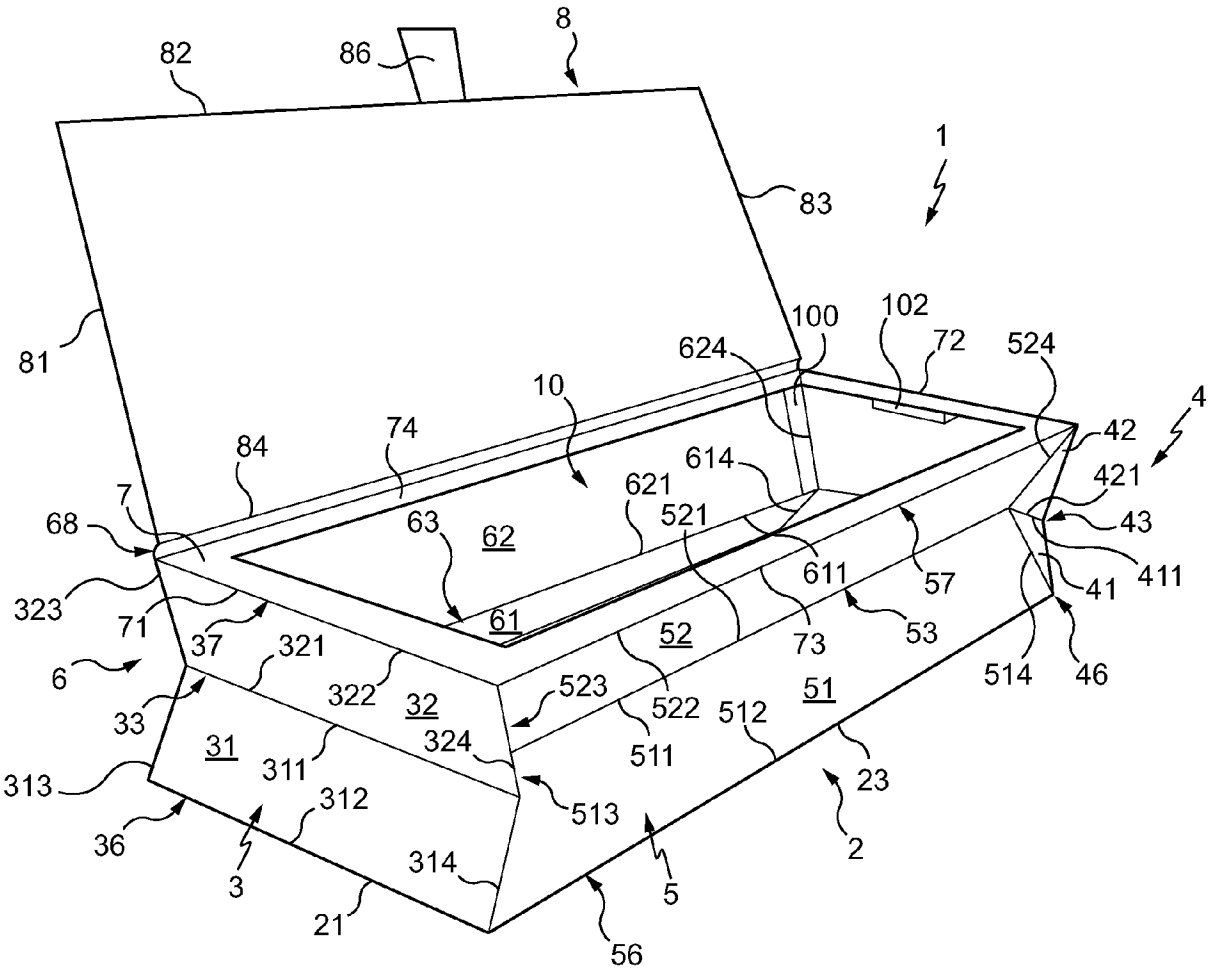
FIG. 1 is a perspective view of a glasses case according to a first example embodiment of the invention, in its deployed configuration, cover open.
Figure 2:
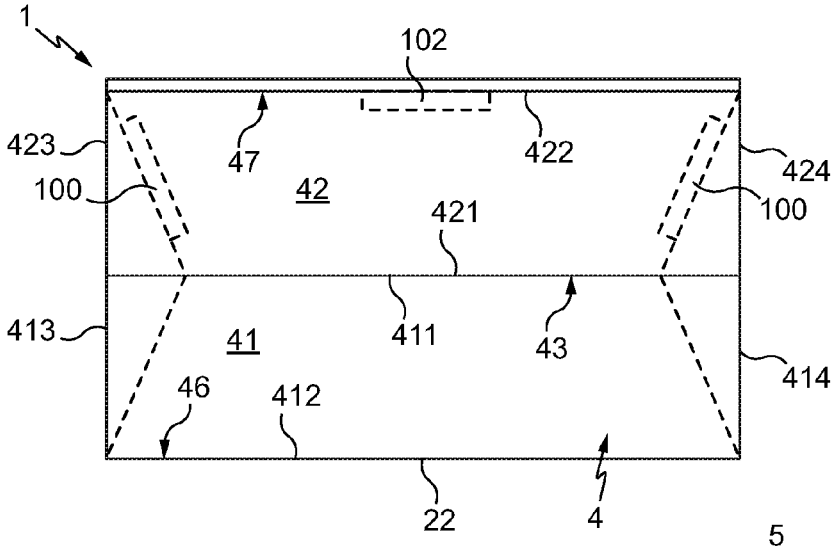
FIG. 2 is a side view of the case in its deployed configuration, cover closed.

FIGS. 1 to 4 illustrate a glasses case 1 in its deployed configuration, comprising a bottom panel 2, four side walls 3, 4, 5, 6, a frame 7 and a cover 8.

The bottom panel 2 has a perimeter formed by four sides, respectively a first side 21 and a second side 22 which are opposite sides, as well as a third side 23 and a fourth side 24 which are opposite sides;

The frame 7, which faces the bottom panel 2, surrounds an entry opening 10 of the case 1 and has an outer perimeter formed by four sides, respectively a first side 71 and a second side 72 which are opposite sides, as well as a third side 73 and a fourth side 74 which are opposite sides.

The first side wall 3 extends between the first side of the bottom panel 21 and the first side 71 of the frame.

The second side wall 4 extends between the second side of the bottom panel 22 and the second side 72 of the frame.

The third side wall 5 extends between the third side of the bottom panel 23 and the third side 73 of the frame.

The fourth side wall 6 extends between the fourth side of the bottom panel 24 and the fourth side 74 of the frame.

Each side wall 3, 4, 5, 6 comprises a first panel 31, 41, 51, 61 and a second panel 32, 42, 52, 62.

Each first panel 31, 41, 51, 61 comprises a first side 311, 411, 511, 611 and each second panel 32, 42, 52, 62 comprises a first side 321, 421, 521, 621, by which first sides the first and second panels of each side wall are hinged to each other.

Each first panel 31, 41, 51, 61 has a second side 312, 412, 512, 612, which is an opposite side to the first side 311, 411, 511, 611, by which it is hinged to the bottom panel 2.

Each second panel 32, 42, 52, 62 has a second side 322, 422, 522, 622, which is an opposite side to the first side 321, 421, 521, 621, by which it is hinged to the frame 7.

The first side wall 3 and the second side wall 4 form a first pair of opposite side walls, and the third and fourth side walls 5 and 6 form a second pair of opposite side walls.

The panels of the first pair of side walls 31, 32, 41, 42 have a rectangular perimeter, their first side 311, 321, 311, 321 and their second side 412, 422, 412, 422 being of equal length and their two remaining sides 313, 314, 323, 324, 413, 414, 423, 424 being straight.

By contrast, the panels of the second pair of side walls 51, 52, 61, 62 have a first trapezoidal perimeter, their first side 511, 521, 611, 621 being shorter that their second side 512, 522, 612, 622 and their two remaining sides 513, 514, 523, 524, 613, 614, 623, 624 slanting.

The cover 8 is adapted to come to bear on an outer surface of the frame 7.

The cover 8 has a perimeter formed by four sides 81, 82, 83, 84, a first side 81 and a second side 82 respectively being opposite sides, as well as a third side 83 and a fourth side 84 which are opposite sides;

The side 84 of the cover 8 is joined to the second side 622 of the second panel 62 of the side wall 6.

The cover 8, by its side 84, is thus hinged to the side wall 6.

Each panel 31, 32, 41, 42, 51, 52, 61, 62 of each side wall 3, 4, 5, 6, the bottom panel 2, the frame 7, and the cover 8 are formed from a rigid material, for example of metal.

Each side wall 3, 4, 5, 6 is formed as a single piece.

Each side wall 3, 4, 5, 6 comprises a fold 33, 43, 53, 63 at the first side 311, 321, 411, 421; 511, 521, 611, 621 of their first and second panels 31, 32, 41, 42, 51, 52, 61, 62 to enable the hinging between those first and second side wall panels.

Each side wall 3, 4, 5, 6 thus has the form of two intersecting half-planes, the first panels 31, 41, 51, 61 each being in a first half-plane, and the second panels 32, 42, 52, 62 each being in a second half-plane, each first and second half plane being separated by the same straight line respectively formed here by the fold 33, 43, 53, 63.

Furthermore, the case 1 has a fold 36, 37, 46, 47, 56, 57, 66, 67 at each side 21, 22, 23, 24 of the bottom panel 2 and at each side 71, 72, 73, 74 of the frame 7.

The case 1 also has a fold 68 at side 84 of the cover 8 by which the latter is hinged relative to the fourth side wall 6.

The glasses case 1 further comprises magnetic metal plates 100 and 102 disposed by bonding, respectively in the vicinity of the remaining sides 523 and 624 on inner faces of the respective panels 52 and 62 of the respective walls 5 and 6, and in the vicinity of the third side 72 on an inner face of the frame 7.

In the deployed configuration of the case 1 (FIGS. 1 to 4), the first panels and the second panels of each side wall 31, 32, 41, 42, 51, 52, 61, 62 are inclined towards each other pointing inwardly.

Furthermore, the first panel and the second panel of the respective walls of the first pair of side walls 31, 32, 41, 42 respectively bear on the remaining sides of the panels of the second pair of side walls 513 and 313, 523 and 323, 414 and 614, and 524 and 624.

The inclination of the these panels makes it possible to have a case 1 having a secure deployed configuration, that is to say without the case 1 automatically resuming its folded configuration, and in which it has sufficient space to insert a pair of glasses (not shown) therein.

Furthermore, the magnets 100 situated in the vicinity of the remaining sides 523 and 624 of the respective panels 52 and 62 exert a force of attraction on the inner metal faces of the panels 42 and 52, which prevents these latter from moving apart, so long as a sufficient force is not applied, in order for the glasses case not to depart from its deployed configuration.

The magnets 100 and the metal panels 32 and 42 thus form a retaining system for those panels 32 and 42 against the remaining sides 523 and 624 of the panels 52 and 62.

It is thus possible to insert a pair of glasses (not shown) into the glasses case 1, and to close the cover 8 by grasping it by a tab 86 which projects from the cover 8 until that cover 8 bears on the outer face of the frame.

Figure 9:
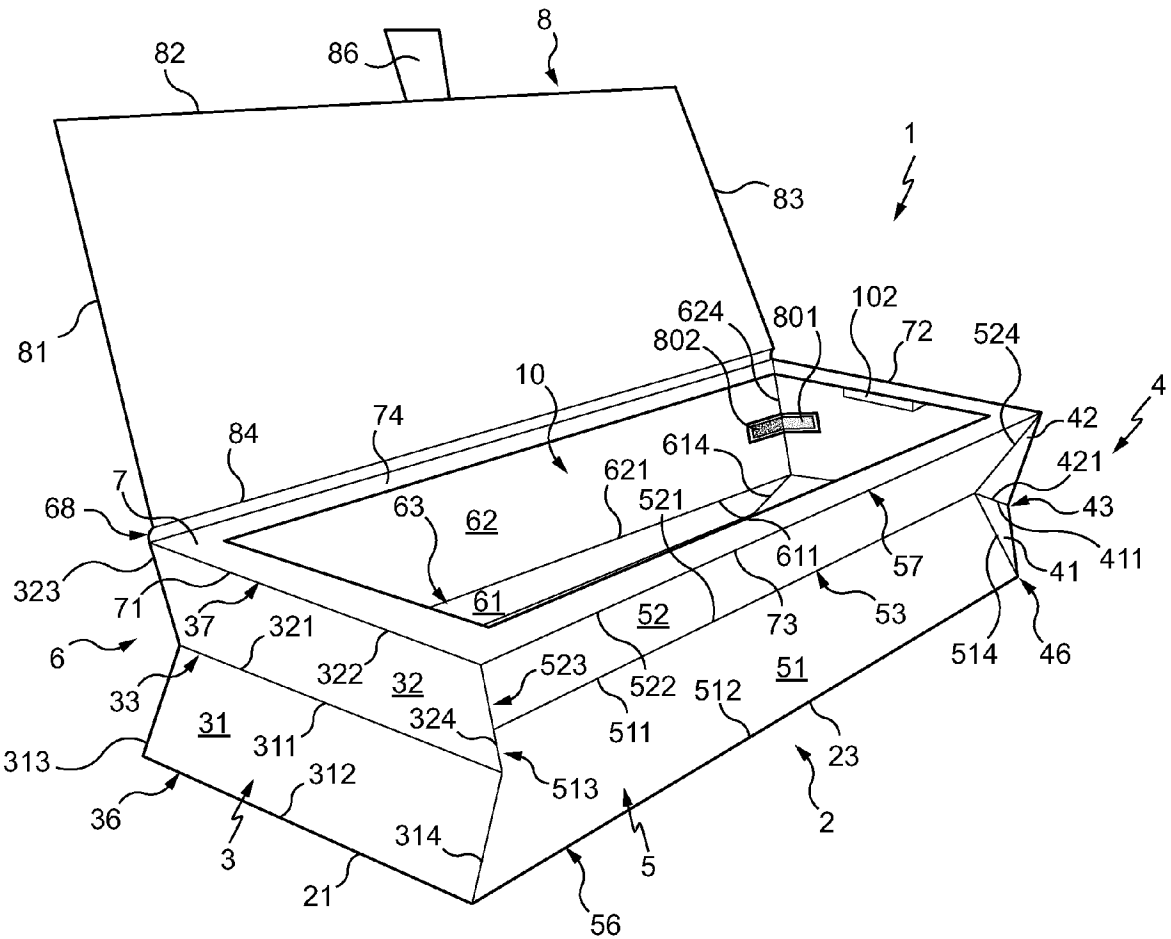
FIG. 9 is a perspective view of a glasses case according to a second example embodiment of the invention, in its deployed configuration, cover open.

FIG. 9 shows a second embodiment of the glasses case where the magnetic metal plate 100 is replaced by self-fastening retaining tabs 801 and 802.

By virtue of the magnets 102, that metal cover 8 is held against the outer face of the frame 7, so as to ensure that the glasses do not come out from the case 1 inadvertently.

Figure 5:
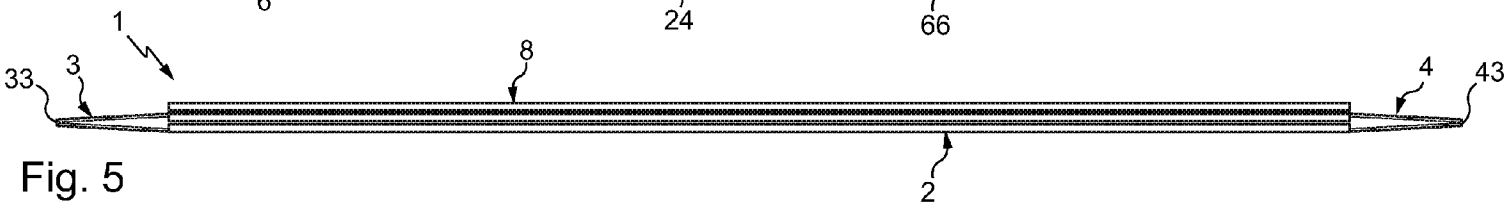
FIG. 5 is a view from the front of the case in its folded configuration, cover closed.

To pass the case 1 from its deployed configuration to its folded configuration, it is necessary to pull the panels 31, 32, 41 and 42 of the side walls 3 and 4 outwards, by exerting a sufficient force to act against the force of attraction exerted by the magnets 100 until the glasses case 1 attains its folded configuration, that is to say when it is totally flat (FIG. 5).

In the folded configuration of the case 1, the first panel and the second panel 31, 32, 41, 42 of each wall of the first pair of side walls 3, 4 are inclined towards each other pointing outwardly while the first panel and the second panel of each wall of the second pair of side walls 51, 52, 61, 62 are inclined towards each other pointing inwardly.

In this case, the panels 31 and 32, and 41 and 42 have their inner faces substantially against each other, pairwise.

Furthermore, the panels 51, 52, 61, 62 are inclined until their outer faces are against each other, pairwise.

Furthermore, the magnets 100 and 102 ensure that the glasses case 1 does not automatically deploy when it is in its folded configuration, so long as a sufficient force is not exerted.

More particularly, the bottom panel 2, the side walls 5 and 6, the frame 7 and the cover 8 are attracted to each other by virtue of the force of attraction exerted by the magnets 100 and 102.

The case 1 thus has an outline of width equal to the width of the bottom panel 2, and an outline of length longer by two side wall (3, 4) panels (31, 32, 41, 42) (one on each side) than the length of the bottom panel 2.

Conversely, to pass the case 1 from its folded configuration to its deployed configuration, it necessary to pull on at least one of the cover 8 and the bottom panel 2, in relation to each other, to move them away from each other, until the glasses case 1 reaches its deployed configuration described earlier.

For this, it is necessary to exert a sufficient force to go against the force of attraction exerted by the magnets 100 and 102.

Figure 6:
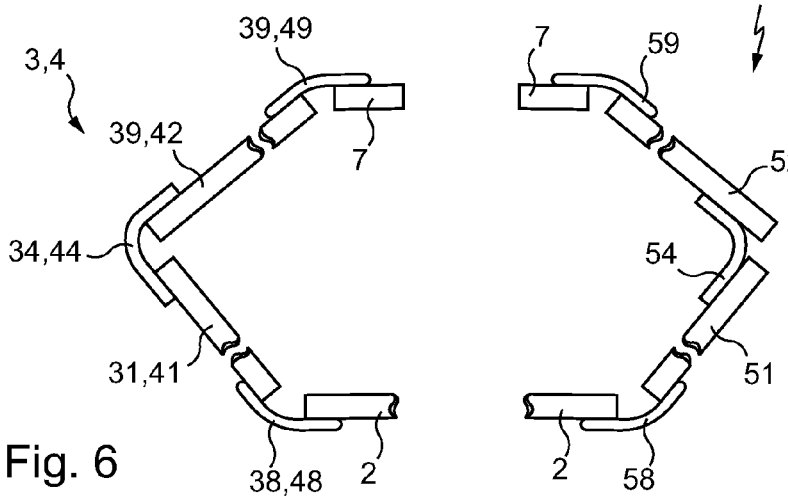
FIG. 6 is a partial cross-section view of a wall of a first pair of side walls, viewed in isolation, of the bottom panel, of the frame of the case according to a second example embodiment of the invention.
Figure 7:
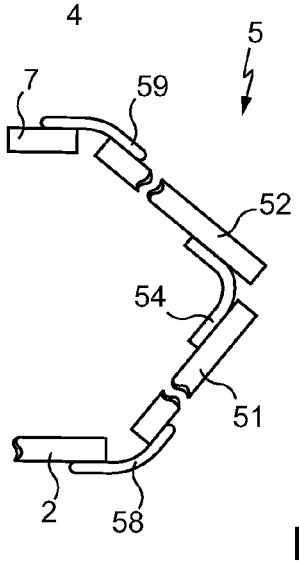
FIGS. 7 and 8 are partial cross-section views similar to that of FIG. 6, respectively of a wall of a second pair of side walls, and of the other wall of the second pair of side walls with the cover of the case.
Figure 8:
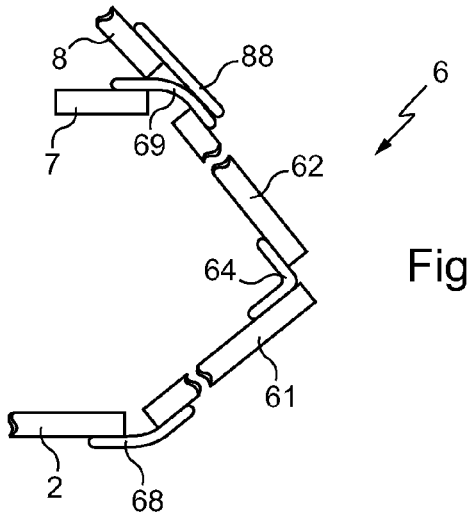
Figure 3:
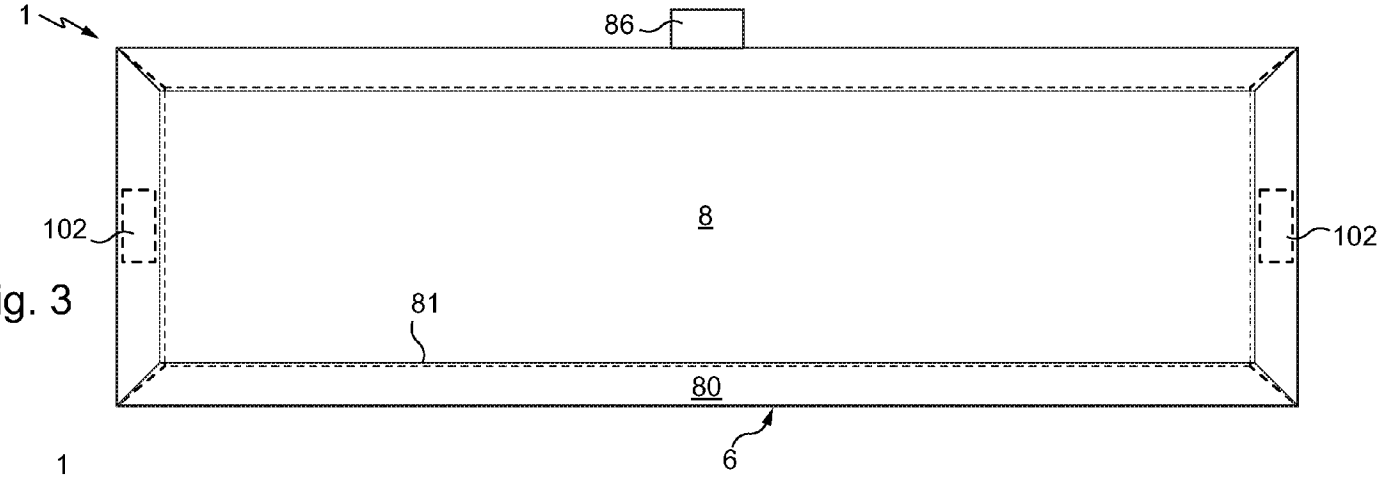
FIG. 3 is a view from above of the case in its deployed configuration, cover closed.
Figure 4:
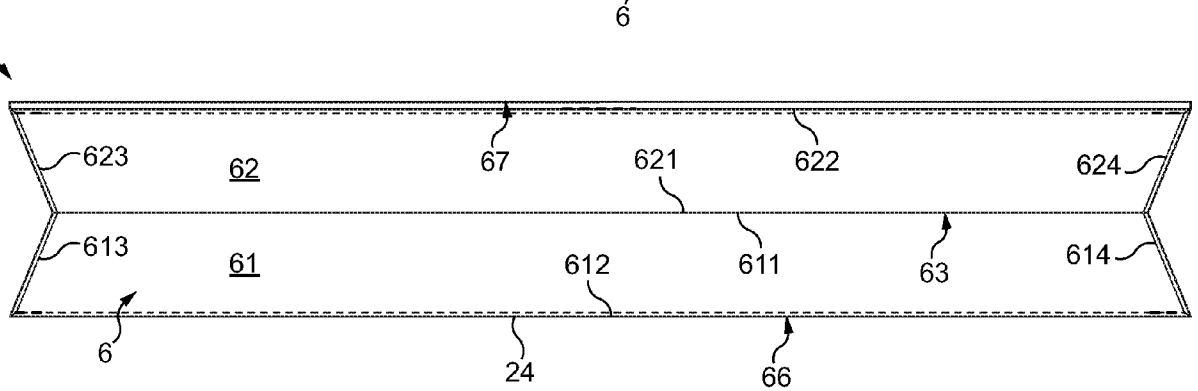
FIG. 4 is a view from behind of the case in its deployed configuration, cover closed.

According to a second example embodiment of the invention illustrated in FIGS. 6 to 8, each side wall 3, 4, 5 and 6 comprises a first linking device, respectively 34, 44, 54, 64 formed from a flexible material such as a textile, which is respectively bonded to the panels 31 and 32, 41 and 42, 51 and 52, and 61 and 62, at the fold that provides the hinge between those panels.

Those first linking devices 34, 44, 54 and 64 thus enable the respective panels 31 and 32, 41 and 42, 51 and 52, 61 and 62 to be joined, while enabling them to be hinged relative to each other.

The first linking devices 34 and 44 of the side walls 3 and 4 are bonded onto the outer faces of the panels 31, 41, 32, 42.

By contrast, the first linking devices 54 and 64 of the side walls 5 and 6 are bonded onto the inner faces of the panels 51, 61, 52, 62.

The side walls 3, 4, 5 and 6 are each hinged to the frame 7 and to the bottom panel 2 by the second and third linking devices, respectively 38 and 39, 48 and 49, 58 and 59 and 68 and 69, similar to the first linking devices which have just been described.

Furthermore, the cover 8, which is opposite the bottom panel 2, is also hinged to the side wall 6 by virtue of a fourth linking device 88 similar to the first, second and third linking devices which have just been described.

In a variant not illustrated, when the case is in its folded configuration, it is the first and second panels of each wall of the second pair of side walls which are inclined towards each other pointing outwardly whereas the first and second panels of each wall of the first pair of side walls are inclined towards each other pointing inwardly.

In this case, it is the panels of each wall of the first pair of side walls which are of trapezoidal shape.

In a variant not illustrated, at least one of the magnets is replaced by a self-fastening retaining tab which is joined, for example by bonding, to a first panel of a side wall.

In this case, a complementary self-fastening retaining tab is necessarily joined to a first panel of a side wall which comes to bear on the first panel comprising the self-fastening retaining tab.

As a variant, the two retaining systems referred to may be combined.

In a variant not illustrated, the panels of the side walls, the bottom panel, the cover, and the frame are formed from a rigid material other than metal, for example of plastic or cardboard.

In a variant not illustrated, at least one of the panels of the side walls, the bottom panel, the cover, and the frame have an outer face and/or an inner face covered at least partially with a textile material such as cloth.

This textile material may be replaced by leather.

A courtesy mirror may also be disposed on an inner face of the cover, or elsewhere in or on the exterior of the case.

It should be noted more generally that the invention is not limited to the examples described and represented.

The invention claimed is:

1. A glasses case having a deployed configuration and a folded configuration, comprising:

a bottom panel (2) having a perimeter formed by four sides (21, 22, 23, 24), respectively a first side (21) and a second side (22) which are opposite sides as well as a third side (23) and a fourth side (24) which are opposite sides;

a frame (7) surrounding an entry opening (10), which frame (7) faces the bottom panel (2) and has an outer perimeter formed by four sides (71, 72, 73, 74), respectively a first side (71) and a second side (72) which are opposite sides as well as a third side (73) and a fourth side (74) which are opposite sides; and four side walls (3, 4, 5, 6), respectively a first side wall (3) extending between the first side of the bottom panel (21) and the first side (71) of the frame, a second side wall (4) extending between the second side (22) of the bottom panel and the second side (72) of the frame, a third side wall (5) extending between the third side (23) of the bottom panel and the third side (73) of the frame, a fourth side wall (6) extending between the fourth side (24) of the bottom panel and the fourth side (74) of the frame; each side wall (3, 4, 5, 6) comprising a first panel (31, 41, 51, 61) and a second panel (32, 42, 52, 62) that are hinged to each other by a first side (311, 411, 511, 611; 321, 421, 521, 621), the first panel (31, 41, 51, 61) having a second side (312, 412, 512, 612), that is an opposite side to the first side (311, 411, 511, 611), by which it is hinged to the bottom panel (2), the second panel (32, 42, 52, 62) having a second side (322, 422, 522, 622), that is an opposite side to the first side (321, 421, 521, 621), by which it is hinged to the frame (2); the first and second side walls (3, 4) forming a first pair of opposite side walls, the third and fourth side walls (5, 6) forming a second pair of opposite side walls, the panels of the second pair of side walls (51, 52, 61, 62) having a trapezoidal perimeter with their first side (511, 521, 611, 621) shorter than their second side (512, 522, 612, 622) and their two remaining sides (513, 514, 523, 524, 613, 614, 623, 624) slanted;

the first panel and the second panel (31, 32, 41, 42) of each wall of the first pair of side walls (3, 4) being inclined towards each other pointing outwardly while the first panel and the second panel (51, 52, 61, 62) of each wall of the second pair of side walls (5, 6) being inclined towards each other pointing inwardly, in the folded configuration of the case (1); and the first panel and the second panel (31, 32, 41, 42, 51, 52, 61, 62) of each side wall (3, 4, 5, 6) being inclined towards each other pointing inwardly, and the first panel and the second panel (31, 32, 41, 42) of each wall of the first pair of side walls (31, 32, 41, 42) bearing on the remaining sides (513, 514, 523, 524, 613, 614, 623, 624) of the panels (51, 52, 61, 62) of the second pair of side walls (5, 6), in the deployed configuration of the case (1);

said glasses case further comprising a first retaining system comprising at least a first member disposed on or being a panel (31, 32, 41, 42) of a wall of the first pair of side walls (3, 4), and at least a second member (100) disposed on a panel (51, 52, 61, 62) of a wall of the second pair of side walls (5, 6), in the vicinity of a remaining side (513, 514, 523, 524, 613, 614, 623, 624) of said panel (51, 52, 61, 62) on which bears said panel of the wall of the first pair of side walls (31, 32, 41, 42) comprising the first member, which first member and second member (100), when they are at a predetermined distance from each other, are subject to a force which holds them at said predetermined distance or at a shorter distance.

2. A case according to claim 1, characterized in that the panels (31, 32, 41, 42) of the first pair of side walls (3, 4) have a rectangular perimeter with their two remaining sides (313, 314, 323, 324, 413, 414, 423, 424) straight.

3. A case according to claim 2, comprising a cover (8) adapted to come to bear against the frame (7), which cover (8) has a perimeter formed by four sides (81, 82, 83, 84), respectively a first side (81) and a second side (82) which are opposite sides as well as a third side (83) and a fourth side (84) which are opposite sides, with one of the four sides (81, 82, 83, 84) of said cover (8) being hinged to the second side (322, 422, 522, 622) of a second panel (32, 42, 52, 62) of one of said side walls (3, 4, 5, 6) or to a side (71, 72, 73, 74) of said frame (7).

4. A case according to claim 2, characterized in that each side wall (3, 4, 5, 6) is formed as a single piece, and in that the first and second panels (31, 32, 41, 42, 51, 52, 61, 62) of each side wall (3, 4, 5, 6) are hinged by a fold formed at the first side (311, 321, 411, 421, 511, 521, 611, 621) of said first and second panels (31, 32, 41, 42, 51, 52, 61, 62) of each side wall (3, 4, 5, 6).

5. A case according to claim 2, characterized in that the first and second panels (31, 32, 41, 42, 51, 52, 61, 62) of each side wall (3, 4, 5, 6) are hinged by a first linking device (34, 44, 54, 64) formed from a flexible material.

6. A case according to claim 1, comprising a cover (8) adapted to come to bear against the frame (7), which cover (8) has a perimeter formed by four sides (81, 82, 83, 84), respectively a first side (81) and a second side (82) which are opposite sides as well as a third side (83) and a fourth side (84) which are opposite sides, with one of the four sides (81, 82, 83, 84) of said cover (8) being hinged to the second side (322, 422, 522, 622) of a second panel (32, 42, 52, 62) of one of said side walls (3, 4, 5, 6) or to a side (71, 72, 73, 74) of said frame (7).

7. A case according to claim 6, characterized in that each side wall (3, 4, 5, 6) is formed as a single piece, and in that the first and second panels (31, 32, 41, 42, 51, 52, 61, 62) of each side wall (3, 4, 5, 6) are hinged by a fold formed at the first side (311, 321, 411, 421, 511, 521, 611, 621) of said first and second panels (31, 32, 41, 42, 51, 52, 61, 62) of each side wall (3, 4, 5, 6).

8. A case according to claim 6, characterized in that the first and second panels (31, 32, 41, 42, 51, 52, 61, 62) of each side wall (3, 4, 5, 6) are hinged by a first linking device (34, 44, 54, 64) formed from a flexible material.

9. A case according to claim 1, characterized in that each side wall (3, 4, 5, 6) is formed as a single piece, and in that the first and second panels (31, 32, 41, 42, 51, 52, 61, 62) of each side wall (3, 4, 5, 6) are hinged by a fold formed at the first side (311, 321, 411, 421, 511, 521, 611, 621) of said first and second panels (31, 32, 41, 42, 51, 52, 61, 62) of each side wall (3, 4, 5, 6).

10. A case according to claim 1, characterized in that the first and second panels (31, 32, 41, 42, 51, 52, 61, 62) of each side wall (3, 4, 5, 6) are hinged by a first linking device (34, 44, 54, 64) formed from a flexible material.

11. A case according to claim 10, characterized in that each first panel (31, 41, 51, 61) of each side wall (3, 4, 5, 6) is hinged to the bottom panel (2) by a second linking device (38, 48, 58, 68), and in that each second panel (32, 42, 52, 62) of each side wall (3, 4, 5, 6) is hinged to the frame (7) by a third linking device (39, 49, 59, 69), said second (38, 48, 58, 68) and third linking devices (39, 49, 59, 69) being formed from a flexible material.

12. A case according to claim 11, comprising a cover (8) adapted to come to bear against the frame (7), which cover (8) has a perimeter formed by four sides (81, 82, 83, 84), respectively a first side (81) and a second side (82) which are opposite sides as well as a third side (83) and a fourth side (84) which are opposite sides, with one of the four sides (81, 82, 83, 84) of said cover (8) being hinged to the second side (322, 422, 522, 622) of a second panel (32, 42, 52, 62) of one of said side walls (3, 4, 5, 6) or to a side (71, 72, 73, 74) of said frame (7) by a fourth linking device (88) formed from a flexible material.

13. A case according to claim 1, comprising at least a second retaining system (102) comprising at least a first member disposed on the bottom panel (2) and at least a second member (102) disposed on the frame (7), facing the first member.

14. A case according to claim 1, characterized in that the first member is formed by the panel on which it is disposed, formed from metal material, and in that the second member is formed by a magnetic metal plate (100, 102).

15. A case according to claim 1, characterized in that the first and second members are formed by self-fastening retaining tabs.

* * * * *